US005235151A

United States Patent [19]

Erdmann

[11] Patent Number: 5,235,151

[45] Date of Patent: Aug. 10, 1993

[54] INDUCTION-HEATED GODET

[75] Inventor: Wolfgang Erdmann, Ratingen, Fed. Rep. of Germany

[73] Assignee: Apparatebau. Dampf- und Kraftanlagen GmbH, Alpenrod, Fed. Rep. of Germany

[21] Appl. No.: 744,060

[22] Filed: Aug. 12, 1991

[30] Foreign Application Priority Data

Aug. 16, 1990 [DE] Fed. Rep. of Germany ..... 4025860
Aug. 23, 1990 [DE] Fed. Rep. of Germany ..... 4026598

[51] Int. Cl.[5] ..... H05B 6/14

[52] U.S. Cl. ..... 219/10.492; 219/10.491; 219/10.614; 219/10.59; 219/10.75

[58] Field of Search ..... 219/10.492, 10.491, 219/10.43, 10.61 R, 10.61 A, 10.493, 10.71, 10.75, 10.79, 10.59

[56] References Cited

U.S. PATENT DOCUMENTS

| | | | |
|---|---|---|---|
| 3,581,060 | 5/1971 | Bauer | 219/469 |
| 3,879,594 | 4/1975 | Shillito | 219/10.491 |
| 4,005,302 | 1/1977 | Graf et al. | 219/10.61 |
| 4,180,717 | 12/1979 | Lenk et al. | 219/10.49 A |
| 4,208,560 | 6/1980 | Turk et al. | 219/10.49 R |
| 4,304,975 | 12/1981 | Lenk et al. | 219/10.49 A |
| 4,647,744 | 3/1987 | Kitano et al. | 219/10.49 A |
| 4,675,487 | 6/1987 | Verkasalo | 219/10.43 |
| 4,822,972 | 4/1989 | Sugioka et al. | 219/10.492 |

FOREIGN PATENT DOCUMENTS

| | | |
|---|---|---|
| 0349829 | 2/1990 | European Pat. Off. . |
| 3527271 | 1/1986 | Fed. Rep. of Germany . |

*Primary Examiner*—Bruce A. Reynolds
*Assistant Examiner*—Tu Hoang
*Attorney, Agent, or Firm*—Sixbey, Friedman, Leedom & Ferguson

[57] ABSTRACT

A godet in which the areas of the magnetic return jacket reaching to the inside periphery of the godet jacket are formed by separate intermediate rings made from magnetically active material, which are placed on front and back ends of the short-circuiting rings and between the short-circuiting rings. Inside surfaces of the short-circuiting rings and intermediate rings, together, form the inside periphery of godet jacket, and the godet jacket has an outside jacket disposed coaxially outside of the magnetic return jacket. Open annular channels are formed between the magnetic return jacket and the outside jacket as well as between the magnetic return jacket and the short-circuiting rings or intermediate rings. The annular channels are connected to one another on both ends by crosswise channels, and the annular channels and crosswise channels are filled with an electrically highly conductive, magnetically inactive liquid metal. The primary winding of the heater is supplied with power in phase displacement so that a field traveling in the axial direction results.

18 Claims, 3 Drawing Sheets

INDUCTION-HEATED GODET

BACKGROUND OF THE INVENTION

The invention relates to an induction-heated godet with a stationary, circularly cylindrical heater and a circularly cylindrical godet jacket coaxially surrounding the heater and rotatable about the heater around a common longitudinal axis, where the heater has a core, preferably consisting of lamellar pieces of sheet metal, with at least three recesses, arranged one after the other in an axial direction, the recesses being open toward the godet jacket, and with a primary winding in each recess, and where the godet jacket has a magnetic return jacket for magnetic flux which reaches into areas between each pair of recesses to the inside periphery of godet jacket, and further, the godet jacket has a secondary winding coaxially disposed within the magnetic return jacket for each primary winding, especially at least one short-circuiting ring made from electrically conductive but magnetically inactive material.

Induction-heated godets serve as draft rolling units, stretch rollers or the like, and are used, for example, in chemical fiber production, sheet production and paper production (cf., for example, EP-A 0 349 829). For godets of the type being discussed, it is essential that the outside surface of the cylindrical godet jacket be at a reactively high temperature to make possible stretching and shrinking of the materials coming in contact with the godet jacket.

Heating of the circularly cylindrical godet jacket, which in operation rotates at high speed around its longitudinal axis, takes place by a heater placed stationary inside the godet jacket. The heater can cause the heating of the godet jacket by heat radiation, heat convection or by induction processes. An inductive heater has proved to be particularly effective, and this invention relates to such an inductive heater.

With an induction-heated godet, i.e., a godet with an inductive heater, a magnetic flux, which is produced by the stationary primary windings on the core of the heater, is enclosed in the godet jacket in the magnetic return jacket made of ferromagnetic material, mostly of iron. In the short-circuiting ring or short-circuiting rings, voltages are induced, which lead to corresponding currents, by which the short-circuiting rings and with it the godet jacket are heated as a whole.

Due to different rates of heat dissipation from the godet jacket, and also as a result of differences inside the godet jacket, different local outputs, etc., temperature differences result on the outside of the godet jacket over its width. These temperature differences must be as small as possible if a good temperature profile is to be kept. For this purpose, with induction-heated godets, steam./liquid systems have been used with only one primary winding; however, these systems are limited to a use range of temperatures up to about 500° K., they age quickly and are not optimal from a wear viewpoint. Circulating systems working with active pumps cannot be used in operationally rapidly rotating godet jackets.

To achieve a good temperature profile even at temperatures of 600° to 750° K., which are necessary for the production of modern industrial synthetic fibers, the primary winding in the heater has been divided into several individual primary windings, mostly two or three primary windings. In this way, a considerable improvement of the temperature profile is obtained, since the working width of the godet jacket is divided into individual sections, which in each case can be adjusted by themselves. The working temperature is not limited by the steam/liquid system, and considerably higher peripheral speeds of the godet are possible.

Also, in the induction-heated godet explained above with several primary windings placed successively in the axial direction, from which the invention starts (DE-A 3 527 271), a temperature profile with a temperature band width of 3° to 4° K. for some uses is not yet optimal.

SUMMARY OF THE INVENTION

In view of the foregoing, a primary object of the present invention is to further improve the temperature profile obtainable.

This object is achieved by providing a godet of the initially mentioned type in which the areas of the magnetic return jacket reaching to the inside periphery of the godet jacket are formed by separate intermediate rings made from magnetically active material, which are placed on front and back ends of the short-circuiting rings and between the short-circuiting rings; wherein the inside surfaces of the short-circuiting rings and intermediate rings, together, form the inside periphery of godet jacket; wherein the godet jacket has an outside jacket disposed coaxially outside of the magnetic return jacket; wherein the open annular channels are formed between the magnetic return jacket and the outside jacket as well as between the magnetic return jacket and the short-circuiting rings or intermediate rings; wherein the annular channels are connected to one another on both ends by crosswise channels; wherein the annular channels and crosswise channels are filled with an electrically highly conductive, magnetically inactive liquid metal (liquid metals according to the technical definition are metals with a low melting point approximately around or below 600° K. and are used as heat carriers in high temperature ranges where other liquids fail for reasons of temperature); and wherein the primary winding of the heater is supplied with power in phase displacement so that a field traveling in the axial direction results.

In the present case, the liquid metal acts first as a short-circuiting ring, i.e., by induced voltages ring currents are produced by areas in the liquid metal, which cause the latter's heating. Moreover, the liquid metal acts as a heat carrier, which serves for temperature equalization over the working width of the godet jacket; but, for this purpose, the liquid metal has to be circulated continuously. This is achieved according to the invention by the special power supply of the primary windings which causes them to act as a kind of linear drive with respect to the liquid metal. Since the electric currents induced in the liquid metal cross the magnetic flux by areas, namely on both ends of the godet jacket and between two primary windings or short-circuiting rings each, longitudinal forces, i.e., axially directed forces, are produced in the liquid metal. The axially directed total force, produced by the traveling field in the liquid metal leads to the liquid metal being conveyed in the annular channels and crosswise channels in the circuit without a pumping system being necessary.

In principle, with three primary windings, they should be supplied with power so that each is displaced 120° in phase. Of course, also in principle other phase angles are possible with another number of primary windings. It is also possible to have several groups of three primary windings, with the groups axially following one after the other, depending on the size of the godet or the working width of the godet jacket.

With the liquid metal circulating system according to the invention, in the godet jacket, the temperature profile can be lowered over a considerable working width of the godet jacket to 1° to 2° K. or even smaller values. By the configuration of the flow channel for the liquid metal, the heat transport characteristic can be influenced in broad limits. In this case, special attention has to be given to the narrow places in the area of the intermediate rings, since here contradictory requirements exist, i.e., for as narrow as possible a gap for an optimal magnetic flux and as great as possible a flow cross section for the liquid metal.

Altogether, it is natural that the receiving space for the liquid metal, formed by the annular channels and crosswise channels, should be hermetically sealed on all sides, so that as few as possible losses result.

Sodium, potassium or a sodium/potassium mixture have proved especially suitable as a liquid metal but other liquid metals or mixtures with liquid metal characteristics can also be used depending on the intended application.

In the prior art, there are short-circuiting rings from an electrically highly conductive material, for example, copper. This is necessary in the prior art, too, since the complete heat for the godet jacket has to be produced in the short-circuiting rings. Corresponding short-circuiting rings made from electrically highly conductive material could also be used in the godet according to the invention. But added to this is the fact that the liquid metal, itself, is an electrically highly conductive material, so that the liquid metal in the areas of the primary windings, itself, acts, in each case, as a short-circuiting ring. As a result, heat production takes place in the liquid metal itself from the currents induced there. Consequently, in the design according to the invention, because of the use of the liquid metal, the short-circuiting rings can be produced even from an electrically moderately conductive material, such as from brass or austenitic steel. The advantage with electrically moderately conductive material or even electrically poorly conductive material for the short-circuiting rings is that the heat then is predominantly directly produced in the liquid metal. Heat losses in the solid/liquid transition, as are unavoidable in the heat transfer from the short-circuiting rings to the liquid metal, are thus avoided or quantitatively reduced.

These and further objects, features and advantages of the present invention will become apparent from the following description when taken in connection with the accompanying drawings which show, for purposes of illustration only, several embodiments in accordance with the present invention.

DETAILED DESCRIPTION OF THE PREFERRED EMBODIMENTS

Figure 1:
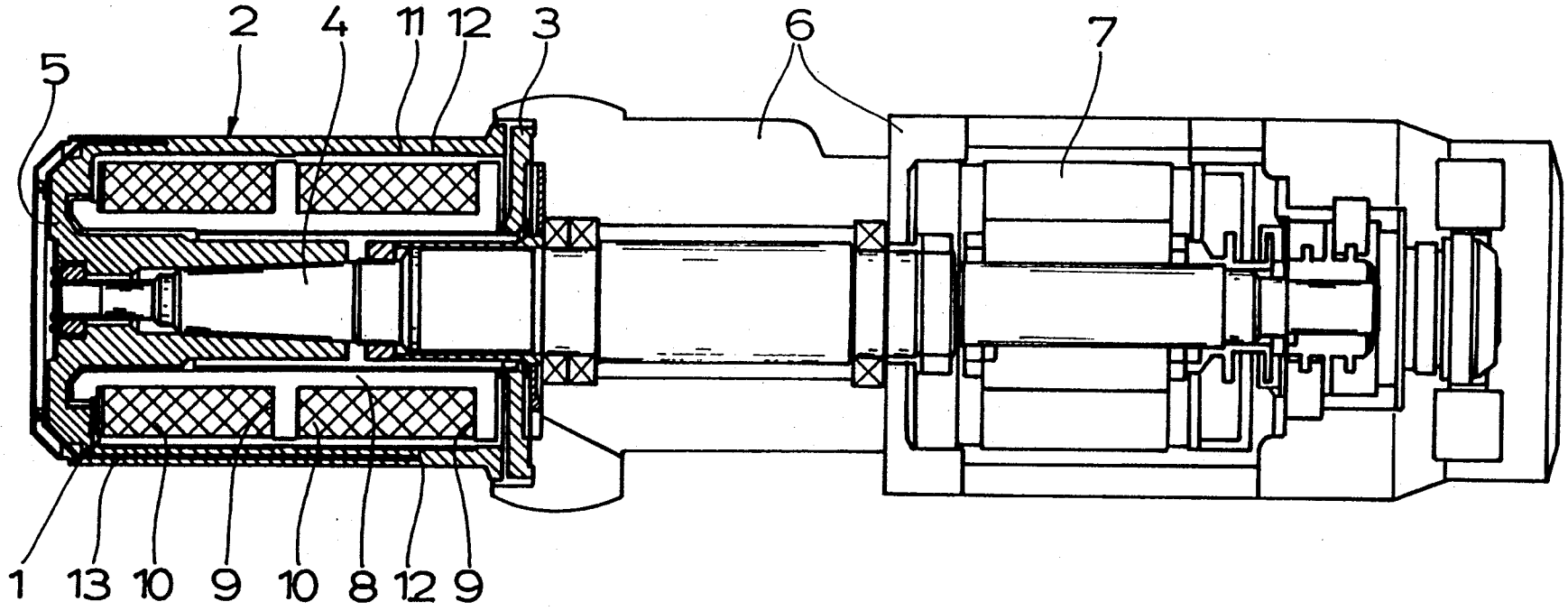
Fig. 1 (PRIOR ART)
FIG. 1 is a diagrammatic, partially cut open, representation of the basic design of an induction-heated godet.

FIG. 1 shows an induction-heated godet having a stationary, circularly cylindrical heater 1 and circularly cylindrical godet jacket 2 coaxially surrounding heater 1 and rotatable about heater 1 around their common longitudinal axis. The outer surface 2a of godet jacket 2 provides a smooth working area with a specific working width, over which the corresponding materials run during operation. Heater 1 is mounted on a stretching support 3 with a drive shaft 4 located coaxially within heater 1. The drive shaft 1 projects from the front of heater 1 and there connects to front wall 5 of godet jacket 2, which thus surrounds heater 1 from front wall 5 like a pot. Drive shaft 4 is rotatably mounted in drive unit 6, which has a conventional integrated drive motor 7 which needs no further explanations here.

FIG. 1 makes it clear that heater 1 comprises a core 8 which, though not depicted as such, according to the preferred embodiment, is formed of lamellar pieces of sheet metal. Two axially spaced recesses 9 are formed by core 8 and open toward the godet jacket outer surface 2a. In similar type of construction, to that shown with two recesses 9 cores 8 are also known with three such recesses 9 but such is not illustrated. It can be seen that a primary winding 10 of the inductively operating heater 1 is disposed in each recess 9.

In FIG. 1, it can first be seen that godet jacket has a magnetic return jacket 11 for the magnetic flux, which reaches into the areas between the recesses 9 to the inside periphery of godet jacket 2. This magnetic return jacket 11 will regularly consist of iron or steel, in any case of a magnetically active, especially ferromagnetic material. It is used to close the circuit for the magnetic flux, which is to bridge only the gap between the inner periphery of godet jacket 2 and the outer periphery of core 8.

Godet jacket 2 also has a secondary winding coaxially within magnetic return jacket 11 for each primary winding 10. These secondary windings are formed by a short-circuiting ring 12 made from electrically conductive but magnetically inactive material. This is only indicated in FIG. 1, by a greater thickness of line having been selected on the corresponding places on the inner periphery of godet jacket 2.

Also, several short-circuiting rings can be provided per primary winding 10. It is important, in each case, that short-circuiting rings 12 be surrounded by the magnetic flux in core 8 and magnetic return jacket 11 so that voltages are induced in them and thus ring currents are produced. In the prior art, copper has proved an especially suitable material for short-circuiting rings 12, but other diamagnetic or paramagnetic materials can also be used in a known way.

Finally FIG. 1 indicates a temperature sensor 13 in godet jacket 2, optionally also several temperature sensors 13 can be provided. It is only indicated that a contactless data transmission takes place from temperature sensor 13 to stationary parts of the arrangement.

Figure 2:
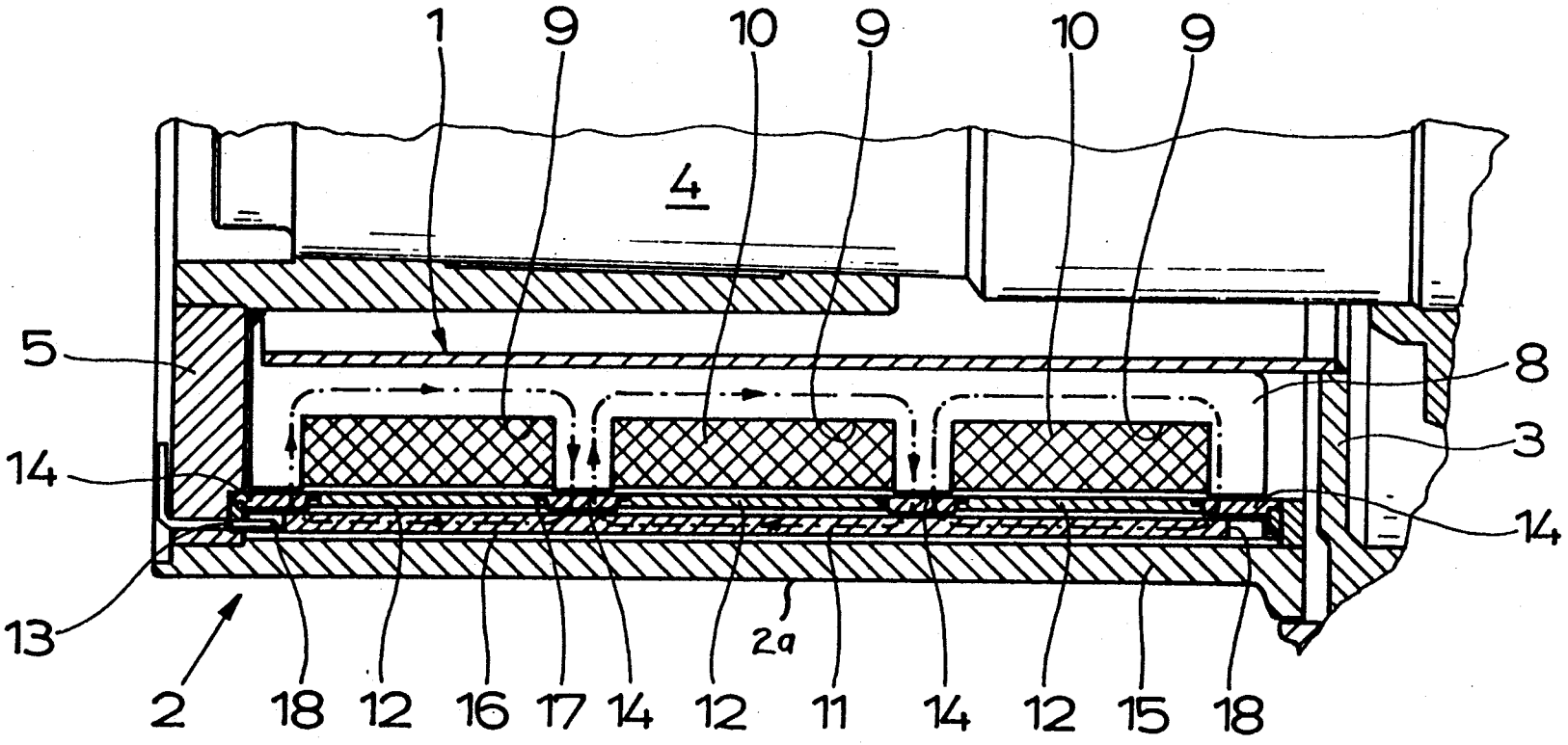
FIG. 2 is an enlarged partially sectioned, portion of an induction-heated godet according to the invention.

First, FIG. 2 uses the same references as FIG. 1 to identify corresponding parts. However, according to the invention, it is essential that the areas of magnetic return jacket 11 are formed of separate intermediate rings 14, made from magnetically active material, which are placed on the front and back ends of the short-circuiting rings 12 and between the short-circuiting rings 12 (four intermediate rings being shown for the three short-circuiting rings), and that the inside surfaces of short-circuiting rings 12 and intermediate rings 14, together, form the inner periphery of godet jacket 2, with the godet jacket 2 having an outer jacket is disposed coaxially outside magnetic return jacket 11, so that open annular channels 16, 17 are formed, respectively, between outside jacket 15 and magnetic return jacket 11 and between magnetic return jacket 11 and short-circuiting and intermediate rings 12, 14, these annular channels 16, 17 being connected to one another at both ends by crosswise channels 18. Annular channels 16, 17 and crosswise channels 18 are filled with a electrically highly conductive, magnetically inactive liquid metal and the primary windings 10 of heater 1 are supplied in phase displacement so that a field traveling in the axial direction results. The liquid metal, which fills annular channels 16, 17 and crosswise channels 18, is not separately drawn in separately in FIG. 2, since to do so would adversely affect the clarity of the figure; but, it is essential to understanding to recognize that the annular channels 16, 17 and crosswise channels 18 are filled with liquid metal.

Figure 4:
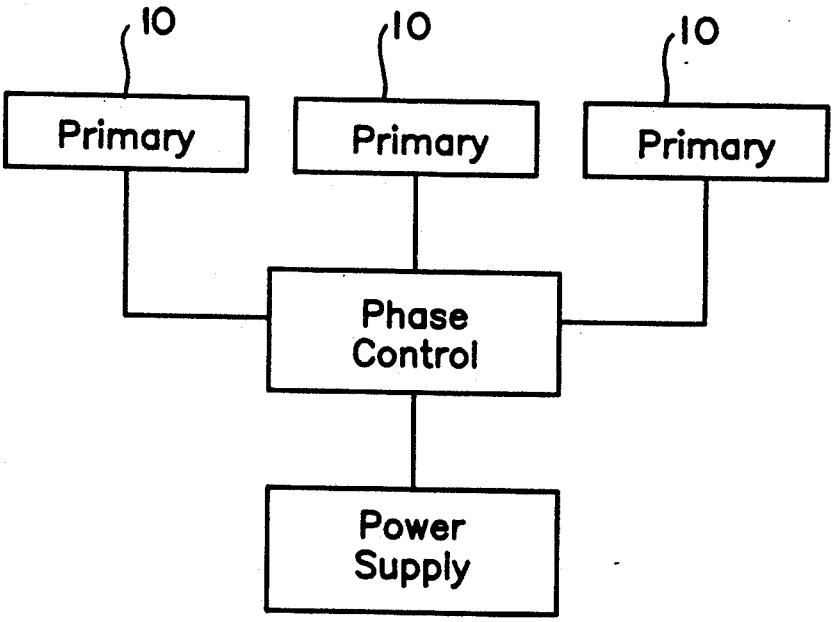
FIG. 4 is a schematic depiction of a phase displacement power control arrangement for the primary windings.

If primary windings 10 of heater 1 are correspondingly supplied in phase displacement, then the circulating effect for the liquid metal results, which was explained in the general part of the description. In principle, with three primary windings, they should be supplied with power so that each is displaced 120° in phase. Of course, also in principle other phase angles are possible with another number of primary windings. It is also possible to have several groups of three primary windings, with the groups axially following one after the other, depending on the size of the godet or the working width of the godet jacket. As a result then the outstanding temperature profile of this induction-heated godet results. FIG. 4 schematically depicts a control arrangement for producing such a phase displacement, it being recognized that the control components, themselves, are conventional and form no part of the present invention apart from their use in the overall combination to produce the noted liquid metal circulating effect. As was also already initially explained, sodium, potassium, mixtures of sodium and potassium or other liquid metals with corresponding electrical and thermal properties are suitable as liquid metals.

In the general part of the description, it was explained that the liquid metal in the areas of the primary windings, itself, acts as a short-circuiting ring, so that now the heat partially or predominantly is produced directly in the liquid metal. Therefore, it is possible to use less electrically highly conductive material for short-circuiting rings 12, for example, brass or an austenitic steel. If the formation of the ring currents is hindered in the actual short-circuiting rings 12 by increasing the resistance in the short-circuiting rings, the development of heat is produced predominantly in the liquid metal. The heat easily and with great efficiency can be brought from the liquid metal, which flows in the circuit, to outside jacket 15.

Figure 3:
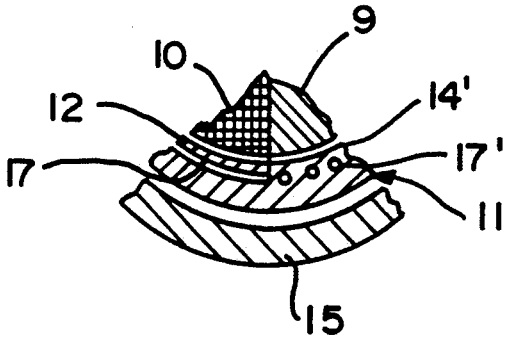
FIG. 3 is a partial cross-sectional view of a modified godet jacket, the right half of which is taken at a point between primary windings and the left half of which is taken through a primary winding.

In the FIG. 2 embodiment, intermediate rings 14, like short-circuiting rings 12, are designed as real rings, which are connected to one another at an inside jacket. But, as an alternative to this, as shown in FIG. 3, it would also be possible for intermediate rings 14' to be shaped on magnetic return jacket 11, and for annular channel 17, in any case, to be formed by many axially running channels 17' that are distributed annularly in the area of intermediate rings 14, 14'.

It is seen in FIG. 2 that temperature sensor 13 juts into crosswise channel 18 near front wall 5, so that liquid metal flows around it and it measures a realistic temperature value, which allows a reliable feedback to the temperature on the outside surface of godet jacket 2 in the working area over the entire working width.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

I claim:

1. Induction-heated godet comprising a stationary, circularly cylindrical heater and a circularly cylindrical godet jacket coaxially surrounding the heater and rotatable about the heater around a common longitudinal axis, the heater having a core, with at least three axially spaced recesses which open toward the godet jacket, and with a primary winding in each recess, and the godet jacket having a magnetic return jacket for magnetic flux and further, the godet jacket has a secondary winding for each primary winding that is coaxially disposed within the magnetic return jacket; wherein each secondary winding is formed by short circuiting rings made from electrically conductive but magnetically inactive material; wherein the secondary windings are separated by intermediate rings made from magnetically active material; which are placed on front and back ends of the short-circuiting rings and between adjacent short-circuiting rings; and wherein inner surfaces of the short-circuiting rings and intermediate rings, together, form an inner periphery of the godet jacket; wherein the godet jacket has an outer jacket disposed coaxially outside of the magnetic return jacket; wherein, annular, axially extending channels are formed between the magnetic return jacket and the outer jacket, and between the magnetic return jacket and an inner periphery of the godet jacket; wherein the annular axially extending channels are connected at one another at opposite ends thereof by crosswise channels; wherein the axially extending annular channels and crosswise channels are filled with an electrically highly conductive, magnetically inactive liquid metal; and wherein a power control is provided by which the primary windings of the heater are supplied with power in phase displacement in a manner producing an axially traveling field results.

2. Godet according to claim 1, wherein the liquid metal is selected from the group consisting of sodium, potassium, a sodium mixture and a potassium mixture.

3. Godet according to claim 2, wherein the short-circuiting rings are formed of an electrically moderately conductive material.

4. Godet according to claim 3, wherein said moderately conductive material is one of brass and austenitic steel.

5. Godet according to claim 2, wherein the short-circuiting rings are formed of an electrically poorly conductive material.

6. Godet according to claim 2, wherein a temperature sensor projects into liquid metal.

7. Godet according to claim 4, wherein a temperature sensor projects into liquid metal.

8. Godet according to claim 6, wherein the short-circuiting rings are formed of an electrically moderately conductive material.

9. Godet according to claim 6, wherein said moderately conductive material is one of brass and austenitic steel.

10. Godet according to claim 6, wherein the short-circuitry rings are formed of an electrically poorly conductive material.

11. Godet according to claim 1, wherein a temperature sensor projects into liquid metal.

12. Godet according to claim 1, wherein the short-circuiting rings are formed of an electrically moderately conductive material.

13. Godet according to claim 1, wherein said moderately conductive material is one of brass and austenitic steel.

14. Godet according to claim 1, wherein the short-circuitry rings are formed of an electrically poorly conductive material.

15. Godet according to claim 13, wherein a temperature sensor projects into liquid metal.

16. Godet according to claim 2, wherein the intermediate rings are shaped on the magnetic return jacket and wherein the annular channel is formed by a plurality of axially running, annularly distributed channels in the area of the intermediate rings.

17. Godet according to claim 1, wherein the intermediate rings are shaped on the magnetic return jacket and wherein the annular channel is formed by a plurality of axially running, annularly distributed channels in proximity to the intermediate rings.

18. Godet according to claim 17, wherein a temperature sensor projects into liquid metal.

* * * * *